US006454867B1

(12) United States Patent
Bourdat

(10) Patent No.: US 6,454,867 B1
(45) Date of Patent: Sep. 24, 2002

(54) METHOD AND MACHINE FOR CLEANING OBJECTS IN PLATE FORM

(76) Inventor: Michel Bourdat, 701 route de Toulouse, 31470 Saint-Lys (FR)

( * ) Notice: Subject to any disclaimer, the term of this patent is extended or adjusted under 35 U.S.C. 154(b) by 0 days.

(21) Appl. No.: 09/831,141

(22) PCT Filed: Nov. 4, 1999

(86) PCT No.: PCT/FR99/02702

§ 371 (c)(1),
(2), (4) Date: May 7, 2001

(87) PCT Pub. No.: WO00/27639

PCT Pub. Date: May 18, 2000

(30) Foreign Application Priority Data

Nov. 6, 1998 (FR) ..... 98 13981

(51) Int. Cl.[7] ..... B08B 3/02; B08B 3/08; B08B 3/12

(52) U.S. Cl. ..... 134/1; 134/10; 134/26; 134/36; 134/61; 134/111; 134/186

(58) Field of Search ..... 134/1, 10, 26, 134/36, 61, 95.3, 111, 186

(56) References Cited

U.S. PATENT DOCUMENTS 5,486,314 A 1/1996 Wack et al.

FOREIGN PATENT DOCUMENTS

| | | |
|---|---|---|
| DE | 32 12 916 | 10/1983 |
| DE | 40 10 679 | 10/1991 |
| JP | 63 058840 | 3/1988 |
| JP | 05 038486 | 2/1993 |
| JP | 06 055151 | 3/1994 |
| JP | 06 164112 | 6/1994 |
| JP | 07 116617 | 5/1995 |

*Primary Examiner*—Zeinab El-Arini

(57) ABSTRACT

The invention concerns a method and a machine for cleaning objects in plate form such as screen printing stencils. The method consists in: immersing an object (2) to be cleaned in a cleansing composition bath consisting of an azeotropic liquid solution having a density not less than the density of residues of average density likely to soil the object (2), and adapted to loosen the residues from the object (2) without solubilising them. The object (2) is placed in a vessel with vertical walls at a distance less than 10 cm from the vertical faces of the object (2). The treating vessel (1) spills over into an overflow vessel (8). The cleansing composition is continuously removed from both vessels (1, 8), filtered and re-introduced in the treating vessel (1) top part.

22 Claims, 3 Drawing Sheets

METHOD AND MACHINE FOR CLEANING OBJECTS IN PLATE FORM

Figure 1:
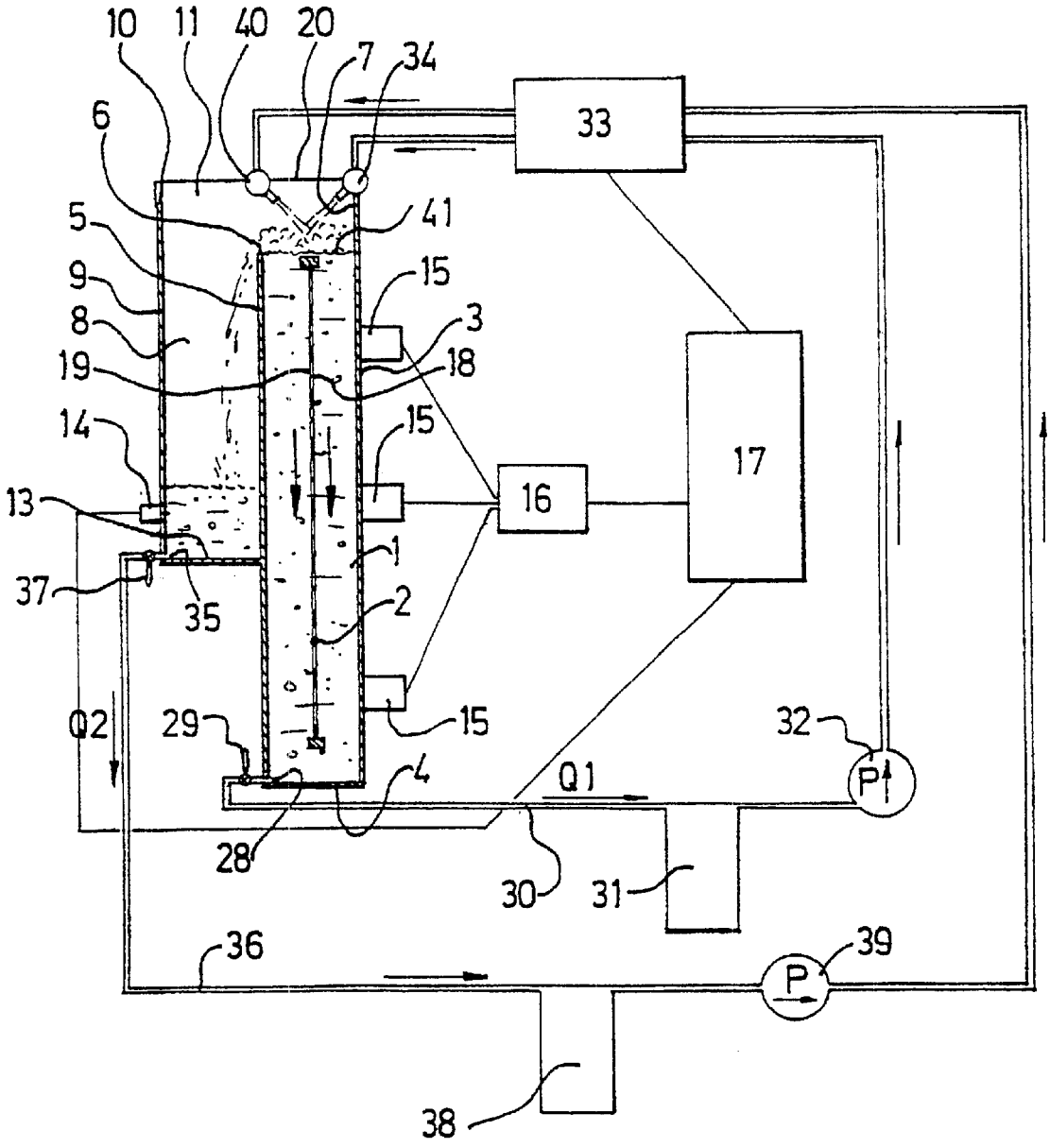

The invention relates to a method and a machine for cleaning objects having the general form of plates, such as screens or stencils for screen printing, notably screen printing stencils used in the production of electronic circuits for depositing adhesives or solder pastes, and more particularly stencils for frames, so-called self-tensioning frames, which are simple flexible fragile thin metal foils.

So far, cleaning of such pieces is often realized in practice manually with the help of solvents on a duster for the glue, or with the help of machines (DE-A-4,010,679) spraying under pressure on the pieces either aqueous solutions with saponification agents or solvents (with all the technical strains imposed by the use of chemicals with an ignition point). Such devices are cumbersome, represent important investments, and do not allow to clean and separate in one step residues of various chemical compositions. However, modern regulations on environment impose to be able to separate residues to allow their recycling, their inerting, or their later destruction according to their chemical composition.

So, with these devices, it is necessary to provide a rinsing step and a residue sorting/separating step. Moreover, the cleansing solutions load with residues and must be regularly renewed, which is expensive and harmful to environment.

Further, these devices do not allow to clean the stencils for self-tensioning frames, which are too fragile for a manual rub cleaning or a pressure spray cleaning.

So, effective technical cleansing compositions are known such as VIGON® SC 200 marketed by the company Dr. O.K. WACK for spray cleaning of screen printing stencils, which has the advantage of eliminating at room temperature adhesives used for surface mounting of components (CMS) and solder pastes, and which is not inflammable. This composition based on water-dissolved alcoxypropanols forms a microphase at a temperature between 20 and 30° C. It is recommended by the manufacturer, after applying the fluid by spraying on objects to be cleaned, to rinse with water. With these compositions, it is noted that the spray-treatment time for each piece is in general more than 1 hour, drying included.

Document PATENT ABSTRACTS OF JAPAN, vol. 95, no. 8, Sep. $29^{th}$ 1995 & JP 07116617 describes a cleaning method and a cleaning machine in which an object is immersed in a cleansing liquid which flows from the bottom up in the treating vessel, spills over into a peripheral overflow vessel, carrying along residues in suspense, and is recycled, after filtering, in the treating vessel bottom part. Precipitated residues of high granularity are extracted because of a high flow rate from the bottom part of the treatment vessel, and then filtered and recycled. This device does not allow in practice to clean pieces and to separate residues of low density, of residues of average density and of residues of high density with an efficiency and a time compatible with industrial operating stresses. Particularly, this device does not allow to separate residues from successive or alternative treatments of pieces soiled with solder pastes (light and heavy residues), and then of pieces soiled with adhesive (residue of average density). Particularly, it is to be noted that the device according to this document does not particularly allow to separate residues of low density from other residues, notably from residues of average density in suspense. This separation is indeed the most difficult one to realize, but it is important, notably insomuch as residues of low density such as fluxes or fats have a chemical composition very different from that of residues of average density such as epoxy glue, and thus need later different treatments. Further, this device which does not comprise any heating means does not allow to use a liquid susceptible of forming a microphase. It works thus either as a solvent, or as a surfactant. Consequently, in such a device, the cleansing liquid dissolves residues, and must thus be regularly renewed, which is expensive and harmful to environment.

The invention aims thus to solve these drawbacks by providing a method and a machine for cleaning objects having the general form of plates, such as screen printing stencils, which can be soiled with residues of average density, notably of density of the order of 1, and/or with solid residues of high density, notably of density not less than 1, and/or with residues of low density, notably of density less than 1, and this under economical conditions compatible with an industrial use, and allowing to separate at least residues of low density.

More particularly, the invention aims to allow to automatically separate residues according to their density, after indifferently successive or alternative treatments of a number of different pieces soiled with residues of any density. Particularly, the invention aims to allow to alternatively treat pieces soiled with residues of low density and with residues of high density, such as screen printing stencils soiled with solder pastes (including fluxes of low density and metal alloy particles of high density), and pieces soiled with residues of average density such as screen printing stencils soiled with glue (residue of average density), and to separate these different residues according to their density at the time of each treatment, without maintenance between two treatments of distinct pieces.

The invention aims thus to allow to treat successively or alternatively pieces soiled with various residues (indifferently of low, high or average density), without any waiting time between pieces.

Particularly, the invention aims to allow to avoid to realize the distinct subsequent steps consisting in rinsing and separating residues, and permanently renewing the used cleansing composition.

The invention aims also to provide a method and a machine which has a low cost-investment, is simple and economical to use and provides a high cleansing efficiency. Particularly, the invention aims to enable a complete treatment (cleansing and drying) with a treatment time less than 1 hour, notably of the order of 0.5 hour, per object.

The invention aims to enable to clean any kind of objects, included fragile objects, such as stencils for self-tensioning frames, soiled with various very resistant residues adhering to the object such as metal particles (solder alloys), solder fluxes, fats, adhesives (epoxy glues, adhesives for CMS, . . . ).

For so doing, the invention relates to a method for cleaning objects having the general form of plates, such as screen printing stencils susceptible of being soiled with residues of average density such as adhesive particles, and/or with solid residues of high density such as metal particles, and/or with residues of low density such as solder fluxes or fats, in which at least one object to be cleaned is immersed in a vessel, so-called treating vessel, filled with a liquid cleansing composition, at least one of vertical walls of the treating vessel, so-called overflow wall, being adapted to form an overflow container into a second adjacent vessel, so-called overflow vessel, the overflow wall being common to the treating vessel and the overflow vessel, at least one flow Q1 of cleansing composition is continuously extracted from the treating vessel and reintroduced into the treating vessel after a passage through filtering means for filtering residues, and a flow Q2 of cleansing composition is continuously extracted from the overflow vessel and reintroduced into the treating vessel after a passage through filtering means for filtering residues, characterized in that:

it is used a cleansing composition formed of a liquid azeotropic solution of a density at least substantially equal to the density of residues of average density, adapted to loose residues from the object without solubilizing them, at least one object is placed vertically into a treating vessel adapted to have at least substantially vertical walls, so-called vertical longitudinal walls, spaced by a distance less than 10cm, from the main faces, disposed at least substantially vertically, so-called vertical faces, of an object to be cleaned.

the cleansing composition is continuously extracted from the bottom part of the treating vessel and is continuously extracted from the overflow vessel, and the whole cleansing composition extracted from both vessels is continuously reintroduced in the top part of the treating vessel, after a passage through said filtering means, the object being immersed into the cleansing composition which continuously flows in the treating vessel along the object downwards with a flow Q1 adapted to:

allow the cleansing composition to produce its effects on residues by loosing them from the object, allow the cleansing composition to carry along residues of average density and residues of high density, allow flotation of residues of low density and their overflow separation into the overflow vessel, so that in one continuous step residues are loosed from the object, at least residues of low density are separated, and residues of the cleansing composition which does not load with residues are extracted.

It is to be noted that a method according to the invention is advantageously applicable to objects having at least as a whole the form of plane plates, the treating vessel having the form of a parallelepiped. Nevertheless, the invention is also applicable to objects which have not strictly the form of plane plates (wavy, cylindrical or hemi-cylindrical plates . . . ). The form of the walls of the treating vessel is adapted to that of objects to be cleaned, so as to have vertical longitudinal walls with forms substantially corresponding to those of main vertical faces of the objects. Advantageously, the objects have main faces in the form of ruled surface (plane, cylinder or portion of cylinder with a circular base or with a base of any form), and the vertical walls of the treating vessel have a similar form.

As the cleansing composition is azeotropic, it is eliminated from the object by simple evaporation (by natural convection or by hot-air drying) without trace. As its density corresponds to that of residues of average density, it carries along these residues in its movement. Residues of high density flow to the bottom of the treating vessel and are carried along with the cleansing composition extracted from the bottom part of the treating vessel.

The cleansing composition is adapted not to solubilize residues, and thus does not load with residues. Advantageously and according to the invention, it is used a cleansing composition formed of an aqueous solution having the effect of loosing residues from the object without solubilizing them.

Advantageously and according to the invention, the cleansing composition is an uninflammable solution.

In the case of screen printing stencils, residues of average density are glues of density close to 1, residues of low density are fluxes of solder pastes or fats, residues of high density are particles of metal weld or solder alloys or those of conductive glues. Advantageously and according to the invention, it is used a cleansing composition the density of which is of the order of 1.

Advantageously and according to the invention, it is used a cleansing composition formed of an aqueous solution of at least one constituent forming a microphase, notably at least an alcoxyalcohol, at a temperature less than 50° C., and the cleansing composition is maintained at a treatment temperature adapted to enable the microphase formation, notably less than 50° C. It is known indeed that in such an aqueous solution in the microphase state, microbubbles of alcoxyalcohol(s) are formed in water, and have an important decomposition power with regard to residues by suppressing their adherence on the support, without nevertheless solubilizing them as a surfactant. For example, it can be used a composition formed of approximately 90% (in weight) and 10% (in weight) of at least one constituent among a propylen glycol ether, such as propylen glycol methyl ether and/or a dipropylen glycol monoether; a polypropylen glycol ether, an alcoxypropanol, such as ethoxypropoxypropanol and/or n-butoxypropanol. Particularly, advantageously and according to the invention, it is used an aqueous solution saturated with at least a cleaning agent as described in U.S. Pat. No. 5,486,314.

As the cleansing composition can be used at low temperature (less than 50° C., notably between 20° C. and 30° C.), any polymerization, reticulation or hardening process, started by residues heating, is avoided, which helps the cleaning.

Advantageously and according to the invention, VIGON®SC200 marketed by the firm Dr O.K. Wack Chemie GmbH (Ingolstadt, Germany) is used as a cleansing composition, the exact chemical composition of which is not known. The density of this cleansing composition is equal to 1. Nevertheless, it is to be noted that, contrary to manufacturer's recommendations, the inventor has surprisingly noted that this composition is highly efficient when used in bath form, i.e. even in the absence of spray supply of mechanical power. It forms a microphase between 20° C. and 30° C.

In other respects, advantageously and according to the invention, the cleansing composition is supplied again by spraying on the free surface of the cleansing composition contained in the treating vessel, from at least one spraying ramp, disposed at a height superior to that of the overflow wall. Advantageously and according to the invention, the cleansing composition is diffused across said free surface. Advantageously and according to the invention, it is used two spraying ramps parallel one to another, jets formed by one ramp intersecting those formed by the other ramp immediately over or at the level of said free surface so as to form a cleansing composition screen having the effect of rinsing an object being extracted from the treating vessel.

Advantageously and according to the invention, the flow Q1 of cleansing composition extracted from the treating vessel is adapted so that the retention time in the treating vessel is comprised between 30 seconds and 5 minutes, notably of the order of 2 to 4 minutes. This flow Q1 is adapted to allow the cleansing composition to carrying along residues of average and/or high density, but also to enable the counter-flow flotation of residues of low density and their filter separation through specific filtering means, and for the cleansing composition to be able to produce its effects on the residues. The value of this flow Q1 can be empirically adjusted by means of tests according to the residue nature, the form of the object and of the treating vessel.

Advantageously and according to the invention, it is used a treating vessel adapted to have vertical longitudinal walls spaced from the vertical main faces of the object by a distance comprised between 1 and 5 cm, notably of the order of 2 to 3 cm. The distance separating the vertical walls of the treating vessel from the faces of the object is as reduced as possible, so as to realize as far as possible in the treating vessel a slow and homogenous flow free of cleansing composition turbulence, and to minimize the quantity of cleansing composition used in the machine.

Indeed, contrary to what the state of the art indicates, the use of a small quantity of cleansing composition has many advantages. As such, it is to be noted that the time necessary for the cleansing composition to be completely filtered and free of all its residues after a treatment operation of a piece is very short (of the order of one minute). Every new piece to be treated is thus immersed into a cleansing composition free of any contamination. Pieces soiled with residues varying from one piece to another can thus successively or alternately be treated without taking risk in contaminating one piece with the residues of another piece that has already been treated, or of interaction of residues of one piece with those of another piece that has already been treated.

Further, advantageously and according to the invention, ultrasonic waves are emitted in the treating vessel in one direction at least substantially perpendicular to the main plane of an object placed in the treating vessel.

Particularly, these ultrasonic waves facilitate the action of the cleansing composition in the interstices or the microperforations in the object.

The invention also applies to a machine for working a process according to the invention.

The invention also relates to a machine for cleaning objects having the general form of plates, such as screen printing stencils, susceptible of being soiled with residues of average density such as glue particles, and/or with solid residues of high density such as metal particles, and/or with residues of low density such as solder fluxes or fats, comprising a vessel, so-called treating vessel, adapted to be able to contain a liquid cleansing composition, and at least an object to be cleaned immersed into this cleansing composition, at least one of the vertical walls of the treating vessel, so-called overflow wall, being adapted to form an overflow container into a second adjacent vessel, so-called overflow vessel, the overflow wall being common to the treating vessel and the overflow vessel, means, so-called first circulation means, for continuously extracting at least one flow Q1 of cleansing composition from the treating vessel and for continuously reintroducing it into the treating vessel after a passage through filtering means for filtering residues, and means, so-called second circulation means, for continuously extracting a flow Q2 of cleansing composition from the overflow vessel, and for continuously reintroducing it into the treating vessel after a passage through filtering means for filtering residues, characterized in that:

the treating vessel is adapted to receive at least one object to be cleaned in a vertical position, and to have at least substantially vertical walls, so-called vertical longitudinal walls, spaced by a distance less than 10cm from main faces, so-called vertical faces, disposed at least substantially vertically, of an object to be cleaned, first circulation means are adapted to continuously extract the cleansing composition from the bottom part of the treating vessel and to continuously reintroduce it in the top part of the treating vessel, second circulation means are adapted to reintroduce in the top part of the treating vessel the cleansing composition extracted from the overflow vessel, first circulation means are adapted to maintain in the treating vessel and along the object, a flow Q1 of cleansing composition flowing downwards and adapted to:

allow the cleansing composition to produce its effects on the residues by loosing them from the object, allow the cleansing composition to carry along residues of average density and residues of high density, allow flotation of residues of low density and their overflow separation into the overflow vessel, so that as the cleansing composition is formed of a liquid azeotropic solution of a density at least substantially equal to the density of residues of average density, and is adapted to loose the residues from the object without solubilizing them, in one continuous step, residues are loosed from the object, at least residues of low density are separated, and residues of the cleansing composition which does not load with residues is extracted.

Advantageously, the machine according to the invention comprises at least one spraying ramp for spraying the cleansing composition onto the free surface of the cleansing composition contained in the treating vessel, this spraying ramp being disposed at a height superior to that of the overflow wall. Advantageously and according to the invention, it comprises two spraying ramps parallel one to another, jets formed by one ramp intersecting those of the other ramp immediately above or at the level of said free surface so as to form a cleansing composition screen having the effect of rinsing an object being extracted from the treating vessel. Advantageously and according to the invention, the spraying ramps are disposed at least substantially above and perpendicularly to the extreme upper edges of two vertical longitudinal walls of the treating vessel, at least one of which forms the overflow wall. Advantageously and according to the invention, a first spraying ramp belongs to first circulation means and a second spraying ramp belongs to second circulation means.

Advantageously and according to the invention, the overflow wall is formed of one of the vertical longitudinal walls of the treating vessel the extreme upper edge of which is at a height inferior to that of the extreme upper edges of the other vertical walls of the treating vessel.

Advantageously and according to the invention, the treating vessel is adapted to have vertical longitudinal walls spaced from vertical main faces by a distance comprised between 1 and 5 cm, notably of the order of 2 to 4 cm.

Advantageously and according to the invention, the machine comprises emission means for emitting ultrasonic waves associated to at least one of the vertical longitudinal walls of the treating vessel so as to emit ultrasonic waves in the treating vessel in a direction at least substantially perpendicular to a main plane of an object placed in the treating vessel.

Advantageously and according to the invention, first and/or second circulation means comprise thermoregulated heating means for heating the cleansing composition, disposed below filtering means for filtering residues, and above reintroduction means for reintroducing the cleansing composition in the top part of the treating vessel.

Advantageously and according to the invention, first circulation means comprise a filter, so-called first filter, and a pump, so-called first pump, and second circulation means comprise a filter, so-called second filter, and a pump, so-called second pump. The first and second filters are similar, and the first and second pumps are similar.

It is to be noted that first circulation means can comprise only one outflow port for the cleansing composition in the bottom part of the treating vessel, and only one filter able to filter residues of average density and to retain residues of high density, while separating them, notably by decantation. For example, this filter can be formed of a container including a cylindrical filtering cartridge through which a liquid to be filtered radially passes. This variant is applicable advantageously when pieces, such as stencils soiled with solder pastes and then pieces soiled with glue are equally well successively or alternately treated. Indeed, in this case, the same filter retains in the container bottom part residues of high density (particles) which it receives when the piece being treated is soiled with solder paste (these residues falling down to the bottom of the container under gravity), and then retains in its cartridge residues of average density which it receives when the piece being treated is soiled with glue (residues being in suspense in the liquid). As such, it is to be noted that, as indicated above, the small quantity of cleansing composition allows to treat successively or alternatively pieces soiled with various residues, with a short waiting time between each piece.

In a variant, two separate outflow ports can be provided, one of which in the bottom part of the treating vessel supplies a filter able to filter residues of high density, whereas the other, situated at an upper level (above the bottom wall of the treating vessel, but nevertheless in the lower part of the treating vessel), supplies another filter able to filter residues of average density. In another variant, an outflow port can be advantageously provided at half height in one of the vertical longitudinal walls of the treating vessel so as to generate a liquid composition flow at least substantially perpendicular to the vertical faces of the object, e.g. in order to facilitate the passage of the cleansing composition through the through ports or perforations in the object and the carrying-along of residues which are incrusted therein.

In all cases, residues of low density are separated in a distinct specific filter of second circulation means.

Advantageously and according to the invention, the treating vessel has the form of a parallelepiped, the width of which is comprised between 3 cm and 10 cm, notably of the order of 5 cm or 6 cm, and has a volume comprised between 10 l and 100 l, notably of the order of 50 l. The height of the treating vessel is at least equal to that of the objects to be cleaned.

Further, advantageously and according to the invention, the machine comprises a suspension frame for suspending an object having the form of a flexible plate in the treating vessel, this suspension frame being adapted to receive and maintain the peripheral edges of the object.

The invention also relates a method and a machine characterized in combination by all or part of the above-mentioned or below-mentioned features.

Figure 2:
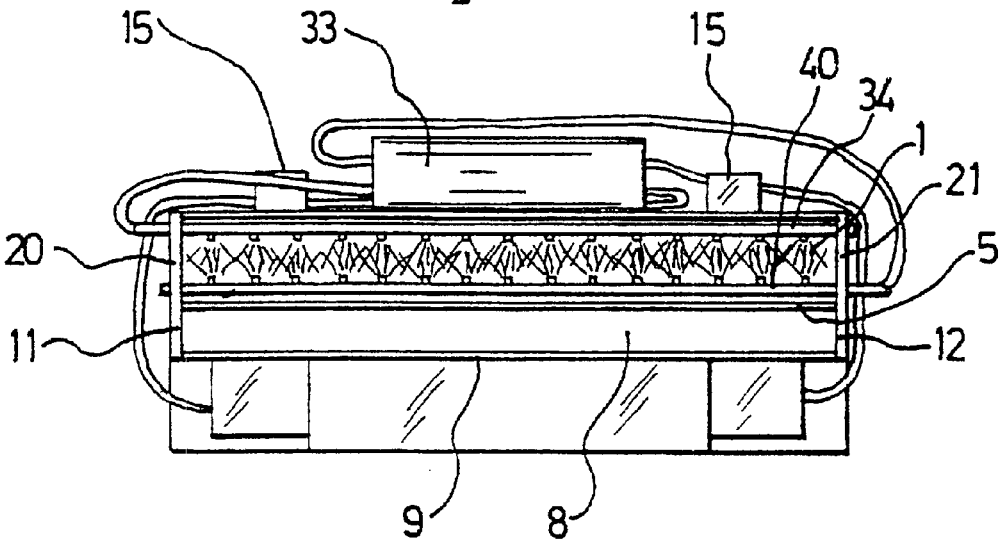
Figure 3:
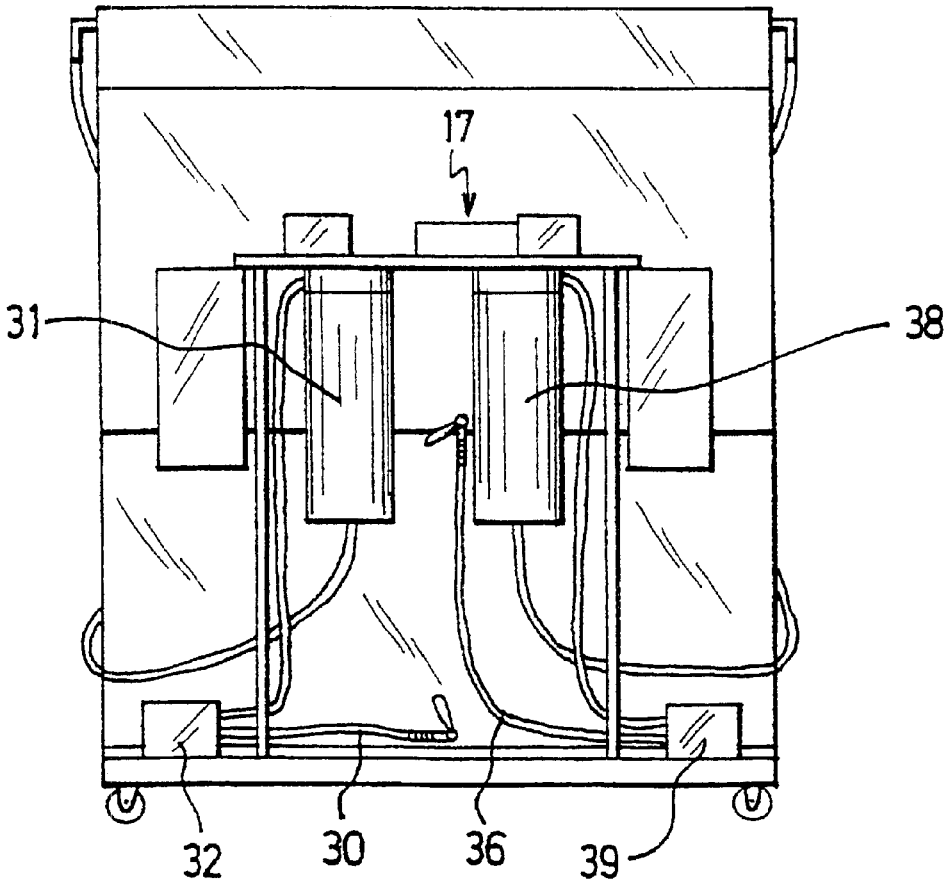
Figure 4:
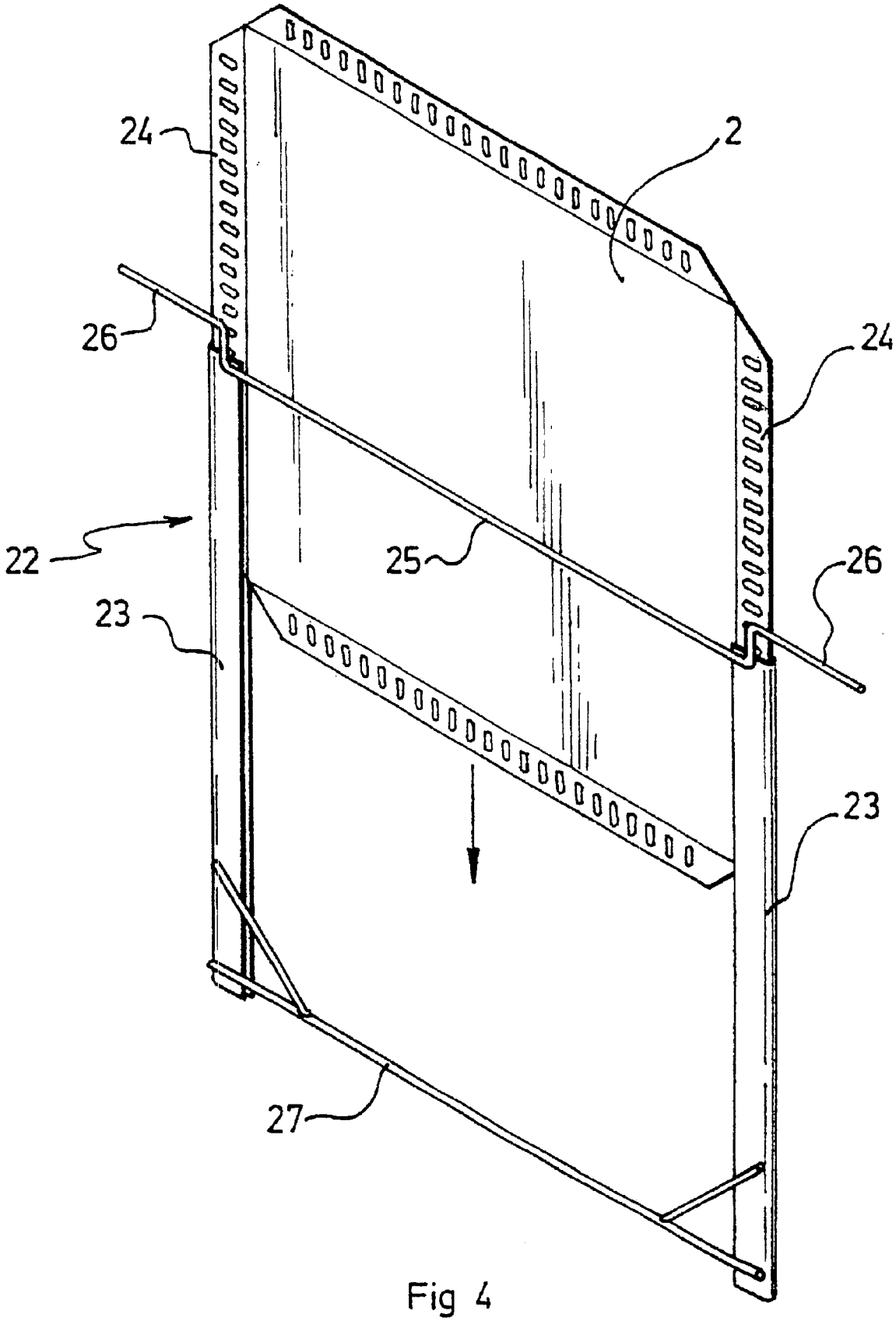

Other objects, characteristics and advantages of the invention will be apparent from the following description of one of its embodiments, which is only illustrative and non limitative of the invention, with reference to the annexed drawings in which:

FIG. 1 is a schematic representation of the general principle of a method and a machine according to the invention, FIGS. 2 and 3 are respectively schematic top and front views of a machine according to the invention the outer casing of which is not represented, so as to allow to visualize its main components, FIG. 4 is a schematic perspective view of a suspension frame of an object having the form of a flexible plate to be placed in the treating vessel of a machine according to the invention.

The machine according to the invention comprises a treating vessel 1 adapted to be able to contain a liquid cleansing composition and at least one object 2 to be cleaned having the general form of a plate such as a screen printing pencil immersed in this cleansing composition. This treating vessel 1 is formed of metal walls in stainless steel and has as a whole the form of a parallelepiped. It comprises a vertical longitudinal outer wall 3, a horizontal lower bottom wall 4, a vertical longitudinal wall 5, so-called overflow wall 5, the extreme upper edge 6 of which is at a height inferior to that of the extreme upper edge 7 of the vertical longitudinal outer wall 3, so that the liquid cleansing composition contained in the treating vessel 1 spills over this extreme upper edge 6 to flow into an overflow vessel 8 adjacent to the treating vessel 1, the overflow wall 5 being a vertical longitudinal wall common to the treating vessel 1 and to the overflow vessel 8. The overflow wall 5 is parallel to and in front of the vertical longitudinal outer wall 3.

In the example represented in FIG. 1, the overflow vessel 8 is less high than the treating vessel 1. The overflow vessel 8 is defined by a vertical longitudinal outer wall 9 which has preferentially an extreme upper edge 10 at a level at least substantially equal to that of the extreme upper edge 7 of the vertical longitudinal outer wall 3 of the treating vessel 1. Both vessels 1, 8 are laterally closed by lateral vertical walls 11, 12. Both vessels 1, 8 are open upwards. The bottom wall 13 of the overflow vessel 8 is at a height superior to the bottom wall 4 of the treating vessel 1. The vertical longitudinal outer wall 9 of the overflow vessel 8 is provided with a level sensor 14 which allows to stop the machine operation if the liquid composition level in the overflow vessel 8 becomes lower than the value predetermined by this sensor 14.

The vertical longitudinal outer wall 3 of the treating vessel 1 is provided with transducers 15, ultrasonic emitters, regularly distributed on the surface of this wall 3. The ultrasonic emitters 15 are supplied by a generator 16 controlled by an electronic control device 17 for controlling the operation of the machine according to the invention. Particularly, this electronic control device 17 incorporates a timer for the operation of the transducers 15, emitting ultrasonic waves.

As seen in FIG. 1, the object 2 to be cleaned is positioned in an at least substantially medial part of the treating vessel 1, at half distance from the vertical longitudinal outer wall 3 and from the overflow wall 5, so that a cleansing composition flow flows vertically downwards along each of the vertical faces 18, 19 of the object 2. The object 2 is placed in the treating vessel 1 so as not to come in contact with the bottom wall 4. For so doing, it is suspended in the treating vessel 1 by any appropriate suspension device, e.g. one or more suspension hooks cooperative with the extreme upper edges 6, 7 of the vertical longitudinal walls 3, 5 and/or the vertical lateral walls 11, 12.

The extreme upper edges 20, 21 of the vertical lateral walls 11, 12 are preferentially at the same level than the extreme upper edges 7, 10 of the vertical longitudinal outer walls 3, 9 of the vessels 1, 8.

The treating vessel 1 can be provided with cross-members connecting the extreme upper edges 6, 7 of its vertical longitudinal walls 3, 5 to facilitate the suspension of objects 2 to be cleaned.

FIG. 4 represents an accessory element allowing to suspend in the treating vessel 1 an object having the form of a thin flexible metal plate, such as a screen printing stencil for a self-tensioning frame. This accessory element is formed of a frame 22 comprising two vertical slide-like posts 23 adapted to receive the vertical peripheral edges 24 of the object 2. Both posts 23 are connected together in the upper part by an upper cross-member 25 welded to these posts 23, and the ends of which project laterally from the post 23 to form suspension tabs 26 able to rest on the cross-members of the treating vessel 1 or on the extreme upper edges 20, 21 of its vertical lateral walls 1, 12. Two parallel cross-members 25, one on each side, can be provided in a non-represented variant.

In the lower part, a cross-member 27 connects also the lower ends of the posts 23. The lower ends of these posts can be closed and welded so as to prevent the sliding of the object 2 beyond these ends. Two cross-members 27 can be provided, in a non-represented variant, one on each side. It is also possible to weld the ends of the cross-element 27 inside the lower end of each slide-like post 23 to close the lower end thereof.

The cleansing composition is extracted from the lower part of the treating vessel 1 and of the overflow vessel 8, filtered, and reintroduced in the top part of the treating vessel 1.

Thus, the treating vessel 1 comprises an outflow port 28 for the cleansing composition provided near the bottom wall 4 of the treating vessel 1, or even in this bottom wall 4, and through which the cleansing composition is extracted. This port 28 is connected via a valve 29 to a line in which are interposed a filter 31, and then a pump 32 which supplies the cleansing composition to a heater 33. At the output of the heater 33, the line 30 supplies a spraying ramp 34 disposed above the extreme upper edge 7 of the vertical longitudinal outer wall 3 of the treating vessel 1.

The filter 31 is adapted to retain residues of average density as well as residues of high density, extracted from the bottom of the treating vessel 1 with the cleansing composition. This filter 31 is for example formed of a cylindrical decanting container containing a cylindrical hollow filtering cartridge through which the composition to be filtered radially passes in a known per se manner.

The pump 32 is an electric pump which is chosen to provide a nominal flow such that the flow Q1 of the cleansing composition extracted from the treating vessel 1 corresponds to a retention time in the treating vessel 1 comprised between 30 seconds and 5 minutes, notably of the order of 2 to 4 minutes, and this in view of the head loss in the circuit. For example, for a treating vessel 1 of the order of 40 l, a pump 32 with a nominal flow of the order of 20 l/minute allows a retention time of 2 to 4 minutes for the cleansing composition in the treating vessel 1.

The heater 33 can be formed of an hollow cylinder partitioned so as to form baffles and can be surrounded by a resistor, all of this being quilted. The electronic control device 17 is adapted to control the operation of the electric pump 32 and of the heater 33.

Thus, first circulation means 28, 29, 30, 31, 32, 33, 34 for circulating the cleansing composition in the treatment vessel 1 are realized.

Similarly, an outflow port 35 is provided at the bottom of the overflow vessel 8. This outflow port 35 is connected to a line 36 via a valve 37. In this line 36 are also interposed a filter 38, and an electric pump 39 which supplies the cleansing composition to the heater 33, and then to a second spraying ramp 40 disposed above the extreme vertical edge 6 of the overflow wall 5. The assembly 35, 36, 37, 38, 39, 33, 40 forms second circulation means for circulating the cleansing composition allowing to extract continuously a cleansing composition flow Q2 from the overflow vessel 8 and to continuously reintroduce it into the treating vessel 1 after a passage through a filter 38, which is adapted to retain residues of low density.

Both spraying ramps 34, 40 are parallel one to another and are provided with nozzles (FIG. 2) regularly distributed on their entire length and oriented downwards and inclined approximately 45° from the horizontal (FIG. 1) inwardly in the treating vessel 1. Each nozzle of a ramp 34, 40 preferentially forms a divergent flaring jet extending at least substantially in a plane inclined downwards for example by approximately 45°, inwardly in the treating vessel 1, and to the jets exiting the nozzles of the other ramp 40, 34. In that way, various jets exiting various nozzles of a common ramp 34 or 40 intersect before contacting the free upper surface 41 of the cleansing composition bath contained in the treating vessel 1. Also, the jets exiting both ramps 34, 40 intersect at a level situated above the free upper surface 41. The result is that the cleansing composition is homogeneously diffused across free upper surface 41 of the cleansing composition bath. Further, when the object 2 is extracted vertically upwards from the treating vessel 1 after its cleaning, the cleansing composition jets exiting both ramps 34, 40 form a screen through which the object 2 passes, which is thus automatically rinsed on its both faces during its extraction from the treating vessel 1. The spraying ramps 34, 40 do not spray directly the object 2 to be cleaned, but only the free surface 41 of the cleansing composition bath in which the object 2 is immersed.

Advantageously, both pumps 32, 39 are similar, so that the flow Q1 extracted from the treating vessel and the flow Q2 extracted from the overflow vessel 8 are similar.

When the machine according to the invention is started, the treating vessel 1 is filled with the cleansing composition until it spills over the overflow wall 5 into the overflow vessel 8 into which a sufficient quantity of cleansing composition is also introduced so that the cleansing composition level in this overflow vessel 8 is above the sensor 14 and the valves 29, 37 are opened. The machine is then started by energizing the electronic control device 17 by means of an appropriate outer control button. The electronic control device 17 controls the operation of the heater 33, of the ultrasonic generator 16, and the pumps 32, 39.

In a non-represented variant, it can also be provided at least a third circulation circuit removing the cleansing composition either at half height, or slightly above the bottom wall 4 of the treating vessel 1, but at a level corresponding at least substantially to the lower part of the object 2 placed in the treating vessel 1. In that way, residues of average density can be extracted, separated and filtered separately. It is then provided a specific filter which can be supplied by means of the same electric pump 32, or a third pump leading to the heater 33 and to the ramp 34.

As seen in FIGS. 2 and 3, the machine according to the invention can be realized in a particularly compact and cheap form.

Further, it is possible to place side by side several objects 2 to be cleaned in the same treating vessel 1, the width of which will be then adapted to this purpose. Several objects can thus be cleaned simultaneously in the same machine. Several ramps or pairs of ramps 34, 40 can be then provided.

Moreover, the machine can be provided with a receptacle for the cleaned objects 2 in view of drying them. This receptacle can be supplied with air by means of an appropriate fan. It is to be noted that the cleansing composition remaining on the object 2 evaporates without trace, since it is an azeotropic cleansing composition which is non loaded with residues.

The electronic control device 17 can incorporate a timer and/or a thermoregulator for operating the heater 33.

EXAMPLE

A machine according to the invention has been realized in accordance with the embodiment represented in the Figures with a width of 60 mm between the vertical longitudinal walls 3, 5 of the treating vessel 1, a height and a length of the order of 85 cm. This treating vessel 1 allows to receive a screen printing stencil having the form of a square plate with a side of 29 inches (73.66 cm). The machine has been used with VIGON® SC 200. The operating temperature was of 25° C. With such a machine, it is possible to treat successively three screen printing stencils for self-tensioning frames in one hour. The so-cleaned stencils are perfectly clean and in perfect condition, and dry. Stencils soiled with solder paste and/or stencils soiled with glue are successively or alternatively treated with a waiting time inferior to 1 minute between two pieces.

What is claimed is:

1. A method of cleaning objects having a general form of plates, susceptible of being soiled with residues of average density, and/or with solid residues of high density, and/or with residues of low density, in which at least one object (2) to be cleaned is immersed in a vessel, so-called treating vessel (1), filled with a liquid cleansing composition, at least one (5) of vertical walls of the treating vessel (1), so-called overflow wall (5), being constructed so as to form an overflow container into a second adjacent vessel, so-called overflow vessel (8), the overflow wall (5) being common to the treating vessel (1) and the overflow vessel (8), at least a first flow (Q1) of cleansing composition is continuously extracted from the treating vessel (1) and continuously reintroduced into the treating vessel (1) after a passage through filtering means (31) for filtering residues, and a second flow (Q2) of cleansing composition is continuously extracted from the overflow vessel (8) and continuously reintroduced into the treating vessel (1) after a passage through filtering means (38) for filtering residues, the method comprising the steps of:

providing a cleansing composition formed of a liquid azeotropic solution of a density at least equal to the density of residues of average density, so as to loosen residues from the object (2) without solubilizing them, placing at least one object (2) vertically in the treating vessel (1) having at least substantially vertical longitudinal walls (3, 5), spaced by a distance of less than 10 cm, from at least substantially vertical main faces of the object (2) to be cleaned, continuously extracting the cleansing composition both from a bottom part of the treating vessel (1) and from the overflow vessel (8), the whole cleansing composition extracted from the treating and overflow vessels (1, 8) being continuously reintroduced in a top part of the treating vessel (1), after passing through said filtering means (31, 38), the object being immersed into the cleansing composition which continuously flows in the treating vessel (1) along the object (2) downwards with the first flow (Q1) so as to:

allow the cleansing composition to loosen the residues from the object (2), allow the cleansing composition to carry along residues of average density and residues of high density, allow flotation of the residues of low density and overflow separation of the low density residues into the overflow vessel (8), so that in one continuous step residues are loosened from the object (2), and at least residues of low density being separated.

2. A method according to claim 1, wherein the cleansing composition comprises an aqueous solution for loosening the residues from the object (2) without solubilizing the residue.

3. A method according to claim 1, wherein the cleaning composition has a density of the order of 1.

4. A method according to claim 1, wherein the cleansing composition comprises an aqueous solution of at least one constituent forming a microphase, at a temperature inferior to 50° C., and wherein the cleansing composition is maintained at a treatment temperature that allows the formation of the microphase.

5. A method according to claim 1, wherein the cleansing composition is reintroduced by spraying onto a free surface (41) of the cleansing composition contained in the treating vessel (1) from at least one spraying ramp (34, 40), disposed at a height superior to that of the overflow wall (5).

6. A method according to claim 5, wherein the cleansing composition is diffused across the entire free surface (41).

7. A method according to claim 5, wherein two spraying ramps (34, 40) parallel one to another are used, jets formed by one of the ramps (34) intersecting jets formed by another of the ramps (40) immediately above or at the level of said free surface (41) so as to form a cleansing composition screen having the effect of rinsing the object (2) being extracted from the treating vessel (1).

8. A method according to claim 1, wherein the first flow (Q1) of cleansing composition extracted from the treating vessel (1) is adapted so that the retention time in the treating vessel (1) is comprised between 30 seconds and 5 minutes.

9. A method according to claim 1, wherein the treating vessel (1) comprises vertical longitudinal walls (3, 5) spaced from the substantially vertical main faces (18, 19) of the object (2) by a distance comprised between 1 to 5 cm.

10. A method according to claim 1, wherein ultrasonic waves are emitted in the treating vessel (1) in a direction at least substantially perpendicular to a main plane of the object (2) placed in the treating vessel (1).

11. A machine for cleaning objects having a general form of plates, susceptible of being soiled with residues of average density, and/or with solid residues of high density, and/or with residues of low density, comprising a treating vessel (1), containing a liquid cleansing composition, and at least an object (2) to be cleaned immersed into the cleansing composition, at least one (5) of vertical walls of the treating vessel (1) being an overflow wall (5) constructed so as to form an overflow container in a second adjacent overflow vessel (8), an overflow wall (5) being common to the treating vessel (1) and the overflow vessel (8), a first circulation means (28, 29, 30, 31, 32, 33, 34) for extracting continuously at least a first flow (Q1) of the cleansing composition from the treating vessel (1) and for reintroducing the cleansing composition continuously into the treating vessel (1) after a passage through a filtering means (31) for filtering residues, and a second circulation means (35, 36, 37, 38, 39, 49) for extracting continuously a second flow (Q2) of the cleansing composition from the overflow vessel (8), and for reintroducing the cleansing composition into the treating vessel (1) after a passage through a filtering means (38) for filtering residues, wherein:

the treating vessel (1) is shaped to receive at least one said object (2) to be cleaned in vertical position, and to have at least substantially vertical longitudinal walls (3, 5), spaced by a distance inferior to 10 cm from vertical main faces of the object (2) to be cleaned, the first circulation means (28, 29, 30, 31, 32, 33, 34) continuously extracting the cleansing composition from a bottom part of the treating vessel (1) and continuously reintroducing the cleansing composition in a top part of the treating vessel (1), the second circulation means (35, 36, 37, 38, 39, 33, 40) reintroducing in the top part of the treating vessel (1) the cleansing composition extracted from the overflow vessel (8), the first circulation means (28, 29, 30, 31, 32, 33, 34) maintaining in the treating vessel (1) and along the object (2), the first flow (Q1) of the cleansing composition flowing downwards so as to:

allow the cleaning composition to loosen the residues from the object (2), allow the cleansing composition to carry along the residues of average density and residues of high density, allow flotation of the residues of low density and overflow separation of the low density residues into the overflow vessel (8), so that as the cleansing composition is formed of a liquid azeotropic solution of a density at least substantially equal to the density of residues of average density, and loosens the residues from the object (2) without solubilizing the residues, in one continuous step, the residues are loosened from the object (2), and at least the residues of low density are separated.

12. A machine according to claim 11, wherein it comprises at least one spraying ramp (34, 40) for spraying the cleansing composition onto a free surface (41) of the cleansing composition contained in the treating vessel (1), this spraying ramp (34, 40) being disposed at a level superior to that of the overflow wall (5).

13. A machine according to claim 12, wherein it comprises two said spraying ramps (34, 40) parallel one to another, jets formed by one ramp (34) intersecting jets formed by another of the ramps (40) immediately above or at level of said free surface (41) so as to form a cleansing composition screen structured to allow rinsing the object (2) being extracted from the treating vessel.

14. A machine according to claim 13, wherein the spraying ramps (34, 40) are disposed at least substantially above and perpendicularly to extreme upper edges (6, 7) of two vertical longitudinal walls (3, 5) of the treating vessel (1), at least one of which forms the overflow wall (5).

15. A machine according to claim 13, wherein the first spraying ramp (34) belongs to the first circulation means (28, 29, 30, 31, 32, 33, 34) and the second spraying ramp (40) belongs to the second circulation means (35, 36, 37, 38, 39, 33, 40).

16. A machine according to claim 11, wherein the overflowing wall (5) is formed of one of the vertical longitudinal walls (3, 5) of the treating vessel (1) an extreme upper edge (6) of which is at a height inferior to that of the extreme upper edges (7, 20, 21) of the other vertical walls (3, 11, 12) of the treating vessel (1).

17. A machine according to claim 11, wherein the treating vessel (1) has vertical longitudinal walls (3, 5) spaced from vertical main faces (18, 19) of the object (2) by a distance comprised between 1 and 5 cm.

18. A machine according to claim 11, wherein it comprises emission means (15, 16) for emitting ultrasonic waves associated to at least one (3) of the vertical longitudinal walls (3, 5) of the treating vessel (1) so as to emit ultrasonic waves in the treating vessel (1) in a direction at least substantially perpendicular to a main plane of the object (2) placed in the treating vessel (1).

19. A machine according to claim 11, wherein at least one of the first (28, 29, 30, 31, 32, 33, 34) and second (35, 36, 37, 38, 39, 33, 40) circulation means comprise thermoregulated heating means (33) for heating the cleansing composition, disposed below the filtering means (31, 38) for filtering residues, and above reintroduction means (34, 40) for reintroducing the cleansing composition in a top part of the treating vessel (1).

20. A machine according to claim 11, wherein the first circulation means (28, 29, 30, 31, 32, 33, 34) comprise a first filter (21) and a first pump (32), wherein the second circulation means (35, 36, 37, 38, 39, 33, 40) comprise a second filter (38) and a second pump (39), wherein the first filter and the second filter are similar, and wherein the first and second pumps (32, 39) are similar.

21. A machine according to claim 11, wherein the treating vessel (1) has the form of a parallelepiped, a width comprised between 3 cm and 10 cm, and a volume comprised between 10 l and 100 l.

22. A machine according to claim 11, wherein it comprises a suspension frame (22) for suspending the object (2) having a form of a flexible plate in the treating vessel, this suspension frame (22) being adapted to receive and maintain peripheral edges (24) of the object (2).

* * * * *